US006935245B2

(12) United States Patent
Schorr et al.

(10) Patent No.: US 6,935,245 B2
(45) Date of Patent: Aug. 30, 2005

(54) RAILWAY CAR FOR TRANSPORTING SEMI-TRUCKS

(75) Inventors: Ralph Hartman Schorr, Lawrenceville, GA (US); Robert J. Cencer, Tecumseh, MI (US); Robert C. Ortner, Jr., Duluth, GA (US); James M. Simpson, Winder, GA (US); Michael J. Rench, Wyandotte, MI (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/957,881

(22) Filed: Sep. 21, 2001

(65) Prior Publication Data

US 2002/0035948 A1 Mar. 28, 2002

Related U.S. Application Data

(60) Provisional application No. 60/234,592, filed on Sep. 22, 2000.

(51) Int. Cl.[7] ..... B61D 11/00

(52) U.S. Cl. ..... 105/355; 105/404; 105/238.1; 296/106

(58) Field of Search ..... 105/355, 404, 105/396, 406.1, 406.2, 238.1, 3, 4.1, 8.1, 343, 413, 4.2, 322, 341, 410; 296/106, 146.8, 156; 414/171, 347, 498; 180/89.1; 410/26, 52, 77, 71, 82, 240; 49/381, 400, 366, 367, 398

(56) References Cited

U.S. PATENT DOCUMENTS

| | | | | | |
|---|---|---|---|---|---|
| 1,254,920 | A | | 1/1918 | Mathias | |
| 2,016,430 | A | | 10/1935 | Hice | |
| 2,761,581 | A | * | 9/1956 | Cohee | 220/1.5 |
| 3,611,949 | A | | 10/1971 | Peisner | |
| 3,995,563 | A | * | 12/1976 | Blunden | 105/378 |
| 4,077,330 | A | * | 3/1978 | Peisner et al. | 105/331 |
| 4,120,076 | A | | 10/1978 | Lebre | |
| 4,263,751 | A | * | 4/1981 | Bennett et al. | 49/501 |
| 4,697,526 | A | * | 10/1987 | Vigliani | 105/199.5 |
| 4,751,883 | A | * | 6/1988 | Bealer | 105/238.1 |
| 4,834,608 | A | | 5/1989 | Middaugh et al. | |
| 4,854,790 | A | | 8/1989 | Andre | |
| 4,867,071 | A | * | 9/1989 | Weber | 105/4.1 |
| 4,917,021 | A | * | 4/1990 | Murphy | 105/225 |
| 5,032,044 | A | * | 7/1991 | Dorst | 410/8 |
| 5,312,213 | A | | 5/1994 | Winsor | |
| 5,320,046 | A | * | 6/1994 | Hesch | 105/355 |
| 5,509,175 | A | * | 4/1996 | Baughan et al. | 16/332 |
| 5,669,745 | A | * | 9/1997 | Anderson | 410/87 |
| 5,743,192 | A | * | 4/1998 | Saxton et al. | 105/355 |
| 5,765,486 | A | | 6/1998 | Black, Jr. et al. | |
| 5,794,537 | A | * | 8/1998 | Zaerr et al. | 105/355 |
| 5,845,584 | A | * | 12/1998 | Bullock et al. | 105/458 |
| 6,142,082 | A | * | 11/2000 | Burke et al. | 105/377.09 |
| 6,227,512 | B1 | | 5/2001 | Andre et al. | |
| 6,283,040 | B1 | | 9/2001 | Lewin | |
| 6,289,822 | B1 | * | 9/2001 | Black et al. | 105/410 |

OTHER PUBLICATIONS

Three photos of a rail–way car believed to be prior art.

Whitehead & Kales Co. brochure, "now's the time to come on strong . . . ship by RAIL!" (4 pages) (date undetermined, believed to be prior art).

Photographs of a railcar believed to have been manufactured by Whitehead & Kales Co. (4 pages) (date undetermined, believed be prior art).

Two (2) pictures of a railcar believed to be prior art.

* cited by examiner

*Primary Examiner*—Frantz F. Jules
(74) *Attorney, Agent, or Firm*—Fitch, Even, Tabin & Flannery

(57) ABSTRACT

The invention is directed to a railway car for the transportation of semi-trucks. The railway car may have an interior defined by a support surface for the trucks, a pair of upstanding sidewalls, and a roof. End doors may be located at each end of the railway car for selectively permitting access to the interior thereof. The horizontal width at the ends of the railway car may be selected to permit the trucks to be loaded into the interior of the railway car.

20 Claims, 7 Drawing Sheets

RAILWAY CAR FOR TRANSPORTING SEMI-TRUCKS

This application claims the benefit of provisional application No. 60/234,592, filed Sep. 22, 2000.

FIELD OF THE INVENTION

The invention relates generally to railway cars, and more particularly to a railway car for transporting semi-trucks.

BACKGROUND OF THE INVENTION

Like passenger cars, semi-trucks, i.e., highway tractors for pulling semi-trailers, typically require shipping from their places of manufacture to their destinations, e.g. distribution centers or dealers. Passenger automobiles are typically shipped long distances utilizing specially-designed railcars or auto racks, as discussed below. Passenger cars also are shipped on highway trailers. Because of their large size, semi-trucks are difficult to transport. Many semi-trucks can be too large and heavy to transport cost-effectively on highway trailers. The problem of transporting semi-trucks has become particularly acute as production of some trucks for U.S. customers has shifted to Mexico, increasing the distances between the place of manufacture and the place of delivery.

Semi-trucks are typically transported on highways or other roadways in a piggy back manner, wherein one mule truck pulls two or three piggy back trucks. In a typical piggy back arrangement, the front end of a first piggy back truck rests on the rear end of the mule truck. The front ends of the second and third piggy back trucks rest on the rear ends of the first and second piggy back trucks, respectively. Dollies may be used to connect the first piggy back truck to the mule truck and to interconnect the piggy back trucks.

In order to transport semi-trucks in this manner, the semi-trucks must be arranged within dimensional constraints required by federal, state, and/or local regulatory agencies. For example, the total maximum allowable length from bumper to bumper for a mule pulling piggy back trucks is usually 75 feet on designated truck routes and 55 feet on other routes. The length constraints usually limit the maximum number of semi-trucks that can be transported in a piggy back arrangement to three or four, including the mule truck. Transporting semi-trucks in this way can be labor intensive, in that a driver is required for each mule truck.

The maximum allowable height of the mule with piggy back trucks is usually 13.5 feet on designated truck routes. In order to avoid exceeding the maximum allowable clearance height, the piggy back trucks may require partial disassembly for transportation. For example, the exhaust stacks and front wheels are often removed. Drive shafts may also be removed. Axles of piggy back trucks may need to be chained to prevent unwanted rotation during transportation. These steps can be time consuming and costly. For trucks having tall cabs, disassembly may be very difficult if not impossible.

Transporting the trucks in a piggy back manner is also disadvantageous because the trucks are exposed to the elements and may arrive at the place of delivery coated in dust or dirt, or even with cracked windshields and scratched or otherwise marred finishes. Damaged trucks may then require restoration to their original condition once delivered, which can involve time-consuming and costly cleaning and/or repairing. In addition, trucks transported in a piggy back manner may be exposed to vandalism and theft.

In an alternative that has been used in the past, some semi-trucks have been shipped on flat cars, such as 90 foot long flat cars. Shipping trucks on flat cars can be undesirable because the flat cars do not have structures enclosing the semi-trucks, thus leaving the trucks exposed to the elements, potential damage, and/or vandalism.

Auto rack cars have proven to be useful in transporting automobiles from the place of manufacture to distribution centers or dealers. Transporting passenger automobiles in enclosed auto rack railway cars can help reduce transportation costs because large quantities of vehicles can be shipped. Auto rack cars, such as disclosed in U.S. Pat. Nos. 5,765,486, 5,782,187, and 5,657,698, typically have a first deck on the floor of the railway car and one or more elevated decks. Auto rack cars also are typically enclosed to prevent vandalism and theft and to deliver the automobiles in good condition. However, semi-trucks will not fit on typical auto rack cars because the vertical clearances between the decks are not sufficient, and the horizontal clearances of the interior may also be insufficient. Auto racks are typically designed with low internal clearances for passenger automobiles that will not accommodate semi-trucks.

The elevated decks may not simply be removed from the interior of an auto rack car in order to adapt them for carrying semi-trucks. The elevated decks in an auto rack car typically are structural members. Without an elevated deck to provide support, sidewalls of an auto rack car may tend to rack or skew sideways. In addition, the end doors of typical auto rack railway cars are usually placed in close proximity to the end of the railway car in order to maximize the number of automobiles that may be transported. When radial end doors are moved into their open positions, they typically are partially recessed against the sidewalls of the auto rack car while remaining within required external clearances. This can require reduced horizontal clearances at ends of the auto rack car, i.e. a narrower opening to the railcar interior. The reduced horizontal clearances are undesirable for transporting semi-trucks, which are generally wider than passenger automobiles.

It has also been known to transport mobile homes, camper trailers, and other recreational vehicles and equipment on modified flat cars. One such flat car was produced in the past by Whitehead & Kales. The Whitehead & Kales car includes a roof and side panels. However, the side panels do not form a complete enclosure for the sides. In addition, the Whitehead & Kales car does not include end doors.

Thus, there remains a need for an improved railway car capable of carrying semi-trucks.

SUMMARY OF THE INVENTION

In accordance with the invention, an enclosed railway car is provided for transporting semi-trucks that provides for increased carrying capacity, reduces the amount of disassembly of the trucks required for transportation, and provides increased protection for the trucks from the elements, as well as from theft and vandalism.

To accommodate the increased widths of the semi-trucks as compared to passenger automobiles, the horizontal clearance of the openings at each end of the railway car is increased. Preferably, only the mirrors on the sides of the semi-trucks need to be adjusted to fit the trucks into the interior of the railway car. Sufficient vertical clearance may be provided so that semi-trucks of certain types may also be arranged in a piggy back manner in the interior of the railway car to increase the number of trucks that may be transported.

The railway car includes a floor having sufficient strength and durability for carrying semi-trucks in commercial rail service. Side posts extend vertically upward along each side of the floor to support upstanding sidewalls. The first side posts are preferably spaced between 4 and 5.5 feet from each end of the railway car. Intermediate side posts are spaced between the first side posts along each side of the railway car. The first side posts and the intermediate side posts on each side of the railway car may be aligned in a substantially coplanar arrangement.

End doors are preferably provided near each end of the railway car, substantially supported by the first side posts. The end doors are selectively operable between an open position for allowing access to the interior of the railway car and a closed position for restricting access to the interior of the railway car. The end doors are pivotally attached to the railway car with hinges proximate the sidewalls of the railway car such that the end doors are substantially aligned with the sidewalls when in their open positions. When the end doors are in their open position, their outer edges, opposite the hinges, preferably do not extend beyond the end of the railway car. Loading and unloading of coupled railway cars is possible without requiring the railway cars to first be uncoupled.

Hinging the end doors proximate the sidewalls allows for an increased horizontal clearance between the first side posts compared to auto rack cars with radial end doors. It is typical in auto rack car radial end doors to have the pivot axes of the end doors spaced laterally inward from the sidewalls and ends of the railway car. The first side posts are also typically spaced laterally inward from the intermediate side posts to provide exterior recesses for the doors when in open positions. The positions of the first side posts reduce the horizontal clearance of the interior of the typical auto rack car. In the preferred embodiment of the invention, the end doors in their open positions are in or near the plane of the sidewalls and set back a sufficient distance, such as 4 to 5.5 feet, from the end of the railway car to prevent the edges of the end doors from extending past the end of the railway car.

According to an embodiment of the invention, the hinges of the railway car may include non-metallic bushings in order to reduce or eliminate the need for greasing or other maintenance of the hinges. The non-metallic bushing may be disposed between a hinge pin and one or more hinge sockets. The doors may be provided with extra reinforcements as compared to end doors on typical auto rack railway cars. The doors may also be provided with exterior lower recessed portions to reduce or avoid interference between the doors in their open position and railcar equipment that may extend above the upper surface of the floor, such as ladders or brake mechanisms.

The hinged end doors may be provided with mechanisms to help support the doors in both their open and closed positions. Due to the weight of the doors, it can be desirable to provide support for the doors in their open and closed positions in order to reduce loads on the sidewalls or side posts to which the doors are attached. The mechanisms may each comprise a roller wheel disposed on the bottom of the door proximate the end of the door opposite the hinge. Elevated supports may be attached to the floor of the railway car so that the roller wheel contacts a first support when in the closed position and a second support when in the open position. While the door is between its open and close positions, the roller wheel may remain out of contact with the floor and the supports. A wedge or riser member may be attached to the top of each support for ensuring that the roller rolls up onto the support.

Locking pins may be disposed proximate bottoms of the doors on surfaces thereof to lock the doors in their fully open or closed positions. The locking pins may be translatable from a retracted or unlocked position to an extended or locked position. The locking pins may be spring biased downwardly toward their extended positions.

A handle or other manual device may be provided on an outer surface of the door for moving the locking pins from a closed position to an open position. Upstanding tubular members can be provided on the floor of the railway car for receiving the locking pins when the doors are in either their open or closed positions. For example, one of the tubular members may be placed on the floor at the location where the locking pin will be when the door is in its closed position. Another tubular member can be placed on the floor at the location where the locking pin will be when the door is in its open position. An inclined ramp member may be placed before each tubular member in order to raise the locking pin to its retracted position so that it clears the top of the raised tubular member. Once the locking pin is in position over the raised tubular member, it can be driven downward by gravity and/or the spring force.

The upstanding sidewalls may be attached to the side posts along each side of the railway car. In an embodiment of the invention, ventilation in the sidewalls of the railway car may be provided by small diameter perforations at select locations, with remaining portions of the sidewalls being imperforate, thereby providing sufficient passive light and ventilation for the interior of the railway car, while substantially reducing admission of airborne particulates. The sidewalls may be load-bearing with structural components positioned to avoid protruding unnecessarily into the car interior. To this end, load bearing shear plates may be used as sidewalls of the railway car. Protection for the doors of semi-trucks carried in the railway car may be provided, e.g., by a plurality of door edge protection strips of a resilient material attached in parallel to one another and vertically spaced from one another along the inside of the sidewalls. The door edge protection strips may be positioned at a range of elevations to enable them to absorb impacts from doors of semi-trucks of various designs and heights.

A roof may be attached to the top of the sidewalls and side posts. The roof may be of a corrugated material having alternating grooves and ridges to provide additional strength to the roof. In an embodiment of the invention, the roof comprises corrugated, galvanized steel.

In order to provide rigidity and structural support to the upstanding sidewalls of the railway car, supports or brackets may extend between opposing sidewalls. Typical auto rack railway cars have one or more intermediate decks for transporting passenger automobiles. These intermediate decks often provide structural support for the upstanding sidewalls and prevent racking of the sidewalls. Semi-trucks require large vertical clearances and weigh much more than typical passenger automobiles, rendering intermediate decks on railway cars impractical. The addition of supports between the posts and roof of the railway car of the invention can help prevent racking of the sidewalls of the railway car and help maintain the sidewalls of the railway car in their upright positions.

Support for the sidewalls of the railway car may be provided by cross members that connect some or all of corresponding pairs of the side posts at their upper ends. The cross members may be rigidly attached to be constrained against angular displacement relative to their associated side posts, so as to provide added support to the side posts to prevent racking of the attached sidewalls. The cross members may be of a contour generally similar to the profile of the roof, with each cross member having side portions extending upward and inward, and a horizontal central portion. The side portions of the cross members may have channel portions for fitting around the upper ends of the side posts. Bolts may be used to attach the cross members at their channel portions to the side posts. The contour of the cross members can be optimized to minimize their intrusion into the interior of the railway car, retaining sufficient vertical clearance between the floor and the cross members. The cross members may be aligned so that they are at least partially recessed in the grooves of the corrugated roof to retain sufficient vertical clearance between the floor and the cross members.

The railway car may comprise an articulated railway car with two car units pivotally connected to each other and sharing a single truck assembly at their connection. An articulated railway car may be configured to transport two semi-trucks loaded end-to-end in each unit of the railway car. Three semi-trucks may be transported in each unit if arranged in a piggy back manner. Railroad industry and government regulations restrict the total length of railway cars in proportion to their widths in order to ensure they can safely navigate typical curves on railway track lines. Accordingly, a longer railway car is usually required to be of a narrower width than a shorter railway car. Providing a railway car in an articulated form having shorter car units allows for each unit to have an increased width, advantageous for transporting wide semi-trucks.

A flexible enclosure may be provided to enclose the space between car units in the articulated railway car. The enclosure may be made of a flexible, resilient elastomeric material or the like, and may have internal reinforcement provided by wires or by other reinforcing material to provide resistance to cutting for improved security. Supports may be provided along the height of the flexible enclosures to help keep them in a preferred alignment.

The railway car may have a plurality of bridge plates spanning the pair of car units at their connection. The bridge plates can allow rolling transport of vehicles between the pivotally interconnected car units for rolling loading and unloading of vehicles. In an embodiment of the invention, the bridge plates may be formed of Metton or other suitable polymers and reinforced with steel wires or strips to provide additional strength in order to reduce deflection of the bridge plates as heavy semi-trucks are driven thereover.

The railway car may also include a pair of bridge plates pivotably mounted on the floor proximate each end thereof, extendable between coupled railway cars. When extended, these bridge plates allow semi-trucks to be driven thereover from one railway car to the next. The extended bridge plates can allow for a train of coupled railway cars to be loaded and unloaded from just one end, greatly simplifying loading and unloading by eliminating the need to uncouple each car separately for loading and unloading.

Semi-trucks often have a pair of front wheels spaced a first distance apart and a pair of rear wheels spaced a second distance apart. To provide for chocking of the wheels of a truck, the floor of the railway car may be provided a first pair of parallel chock tracks substantially aligned with the front wheels of the truck. The floor of the railway car may also include a second pair of parallel chock tracks substantially aligned with the rear wheels of the truck. In a preferred embodiment, the chock tracks are attached to the upper surface of the floor and extend upwards therefrom. However, the chock tracks may also be provided recessed in the floor such that the tracks are flush with the upper surface of the floor.

Additional features and advantages of the invention are disclosed in the detailed description of the preferred embodiments and in the accompanying drawings.

DETAILED DESCRIPTION OF PREFERRED EMBODIMENTS

Figure 1:
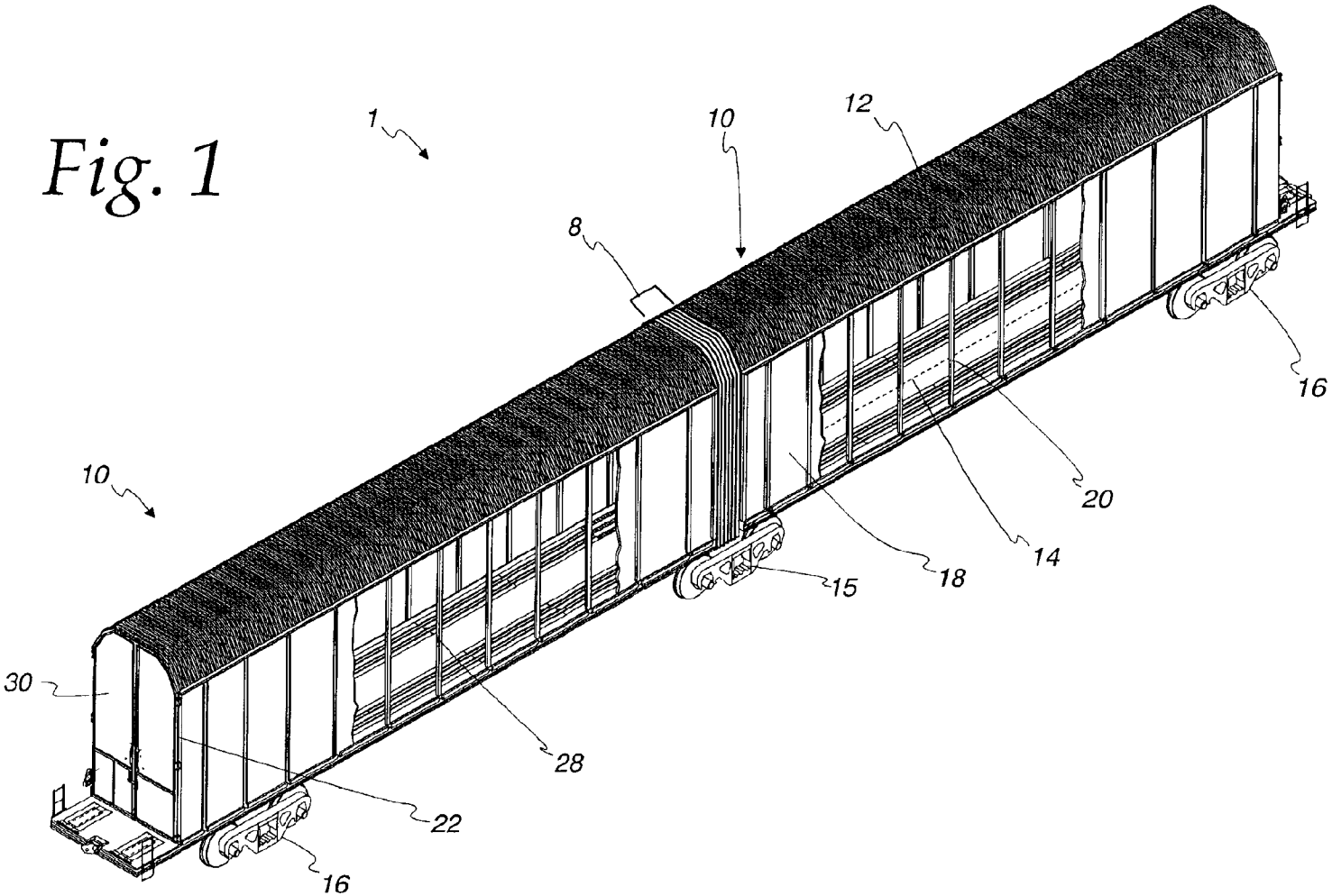
FIG. 1 is a perspective view of an articulated railway car in accordance with an embodiment of the invention.

A railway car 1 comprising two substantially identical railway car units 10 connected at an articulation 8 is shown in the embodiments illustrated in FIGS. 1–11. As illustrated in FIG. 1, each railway car unit 10 generally comprises a support structure comprising a floor 14 having a plurality of vertical side posts 20 extending upwardly proximate lateral edges thereof. A pair of upstanding sidewalls 18 are connected to the vertical posts 20 and extend along the longitudinal edges of the railway car 1. A roof 12 extends between opposite sidewalls 18 to enclose the railway car 1. An end truck 16 is positioned below the floor 12 and near each end of the railway car 1 and a shared central truck 15 is positioned at the articulation 8. A flexible enclosure 26 extends across the articulation 8 and between the units 10 of the railway car 1. A pair of end doors 30 are provided proximate an end of each unit 10 opposite the articulation 8 to selectively provide access to the interior of the railway car 1.

Figure 8:
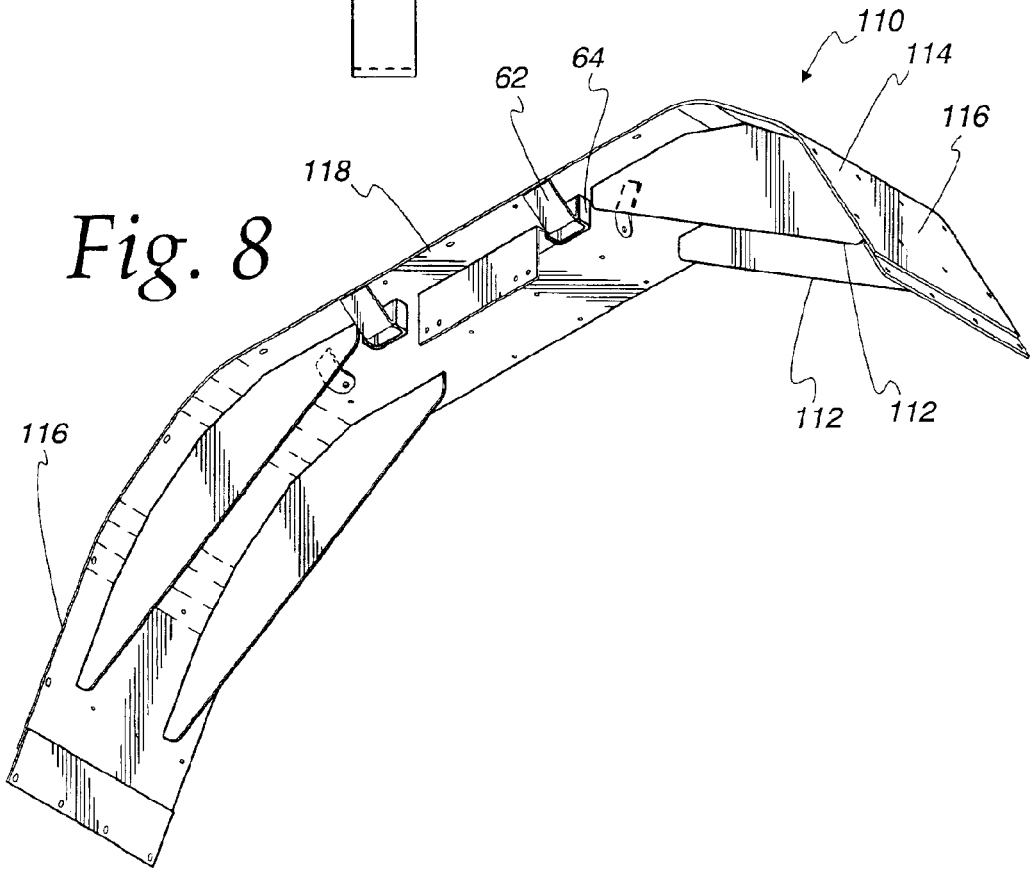
FIG. 8 is a perspective view of a bracket assembly of the railway car of FIG. 2.

A bracket assembly 110 is provided at the ends of each railway car unit 10 to constrain the sidewalls 18 so that racking of the sidewalls 18 remains within acceptable limits. The bracket assemblies 110 are connected to the interior of the roofs 12 proximate the ends of each railway car unit 10 and extend laterally across the railway car 1. As illustrated in FIG. 8, the bracket assemblies 110 each comprise a bracket frame 114 having a profile that approximately corresponds to the profile of the interior of the roof 12. The bracket frame 114 comprises side portions 116 extending downwardly from a central portion 118. A plurality of brace members 112 extend between the side portions 116 and the central portion 118 to reinforce the bracket frame 114.

Figure 2:
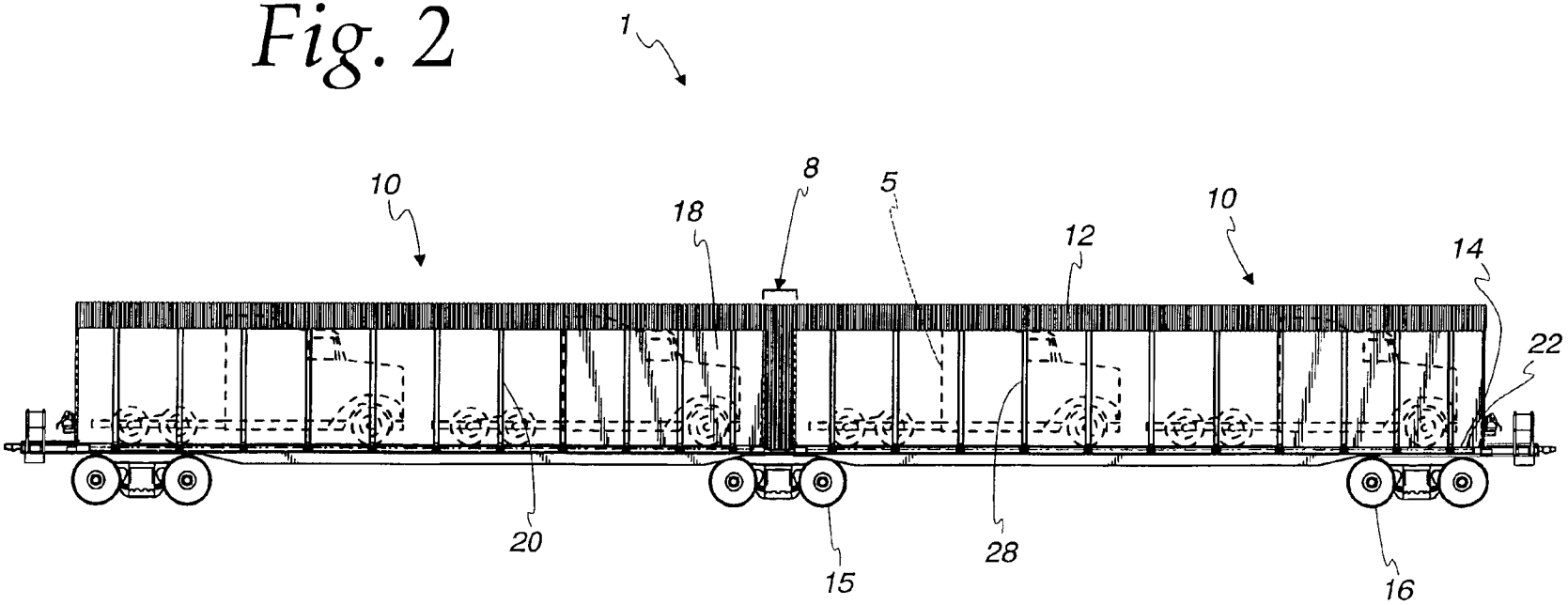
FIG. 2 is a side elevational view of the articulated railway car of FIG. 1 illustrating semi-trucks arranged in the interior of the railway car.
Figure 3:
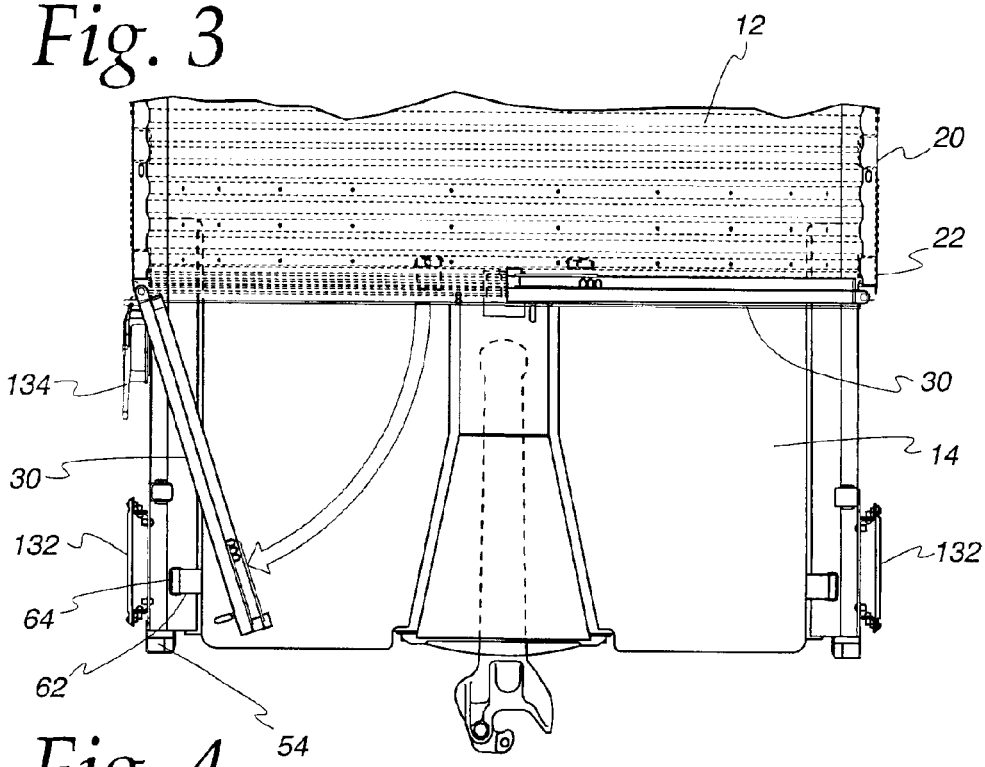
FIG. 3 is a plan view of an end portion of the railway car of FIG. 1 showing an end door in its open position and an end door in its closed position.

In the embodiments illustrated in FIGS. 1–12, the side posts 20 include a pair of first side posts 22 at each end of the railway car 1, as illustrated in FIGS. 1–3. The horizontal clearance between the first side posts 22 is between 9.5 and 10 feet. Intermediate side posts 28 are spaced along opposite sides of the railway car 1 between the first side posts 22. The first side posts 22 are substantially coplanar with the intermediate side posts 28 on the respective sides of the railway car 1. The first side posts 22 are spaced inwardly between 4 and 5.5 feet from the ends of the railway car 1.

The end doors 30 of each unit 10 of the railway car 1 are attached proximate the first side posts 22 and are operable between open and closed positions, as illustrated in FIG. 3. When the end doors 30 are in their open positions, access is provided to the interior of the railway car 1. The horizontal clearance between the end doors in their open position is between 9.5 and 10 feet. By having the first side posts 22 spaced inwardly from the ends of the railway car 1, when the end doors 30 are in their open positions they do not extend beyond the end of the railway car 1. In the illustrated embodiment, the doors 30 in open position do not extend beyond the striker. However, in other embodiments the doors 30 may be configured to extend beyond the striker when open. In either case, the doors 30, when open, preferably do not interfere with open doors on an adjacent car, and preferably are pivoted about axes spaced a sufficient distance inward of the striker to achieve sufficient clearance for the cars to be moved with the doors 30 open, while complying with applicable safety standards.

Figure 4:
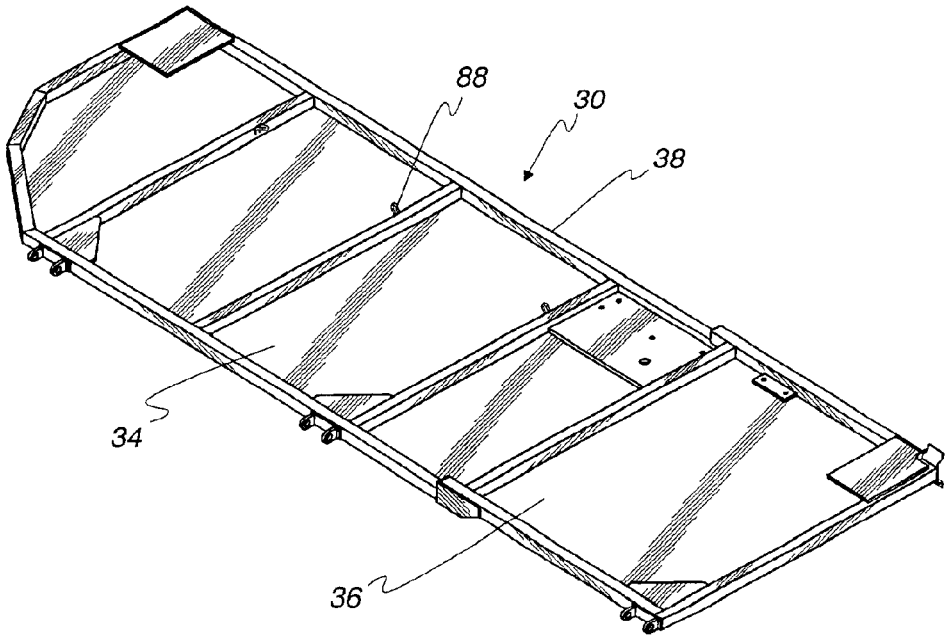
FIG. 4 is a perspective view of one of the end doors of FIG. 3.
Figure 5:
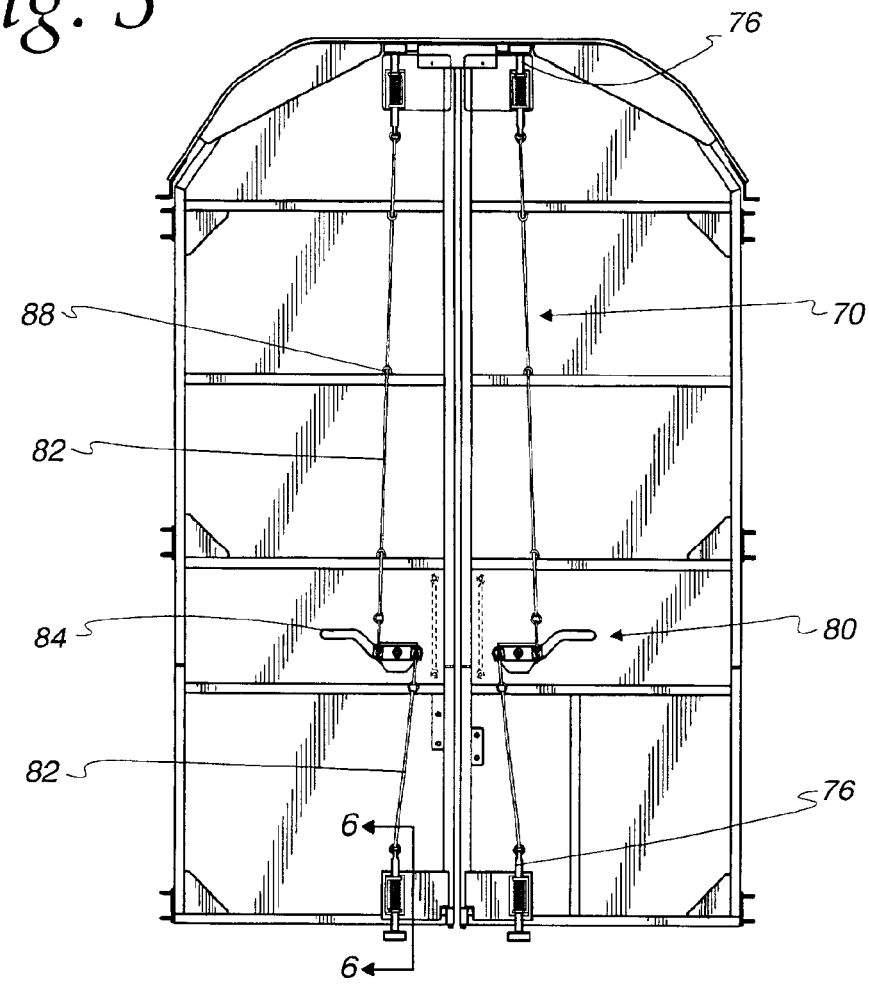
FIG. 5 is an elevational view of the inside portion of the end doors of FIG. 3.
Figure 6:
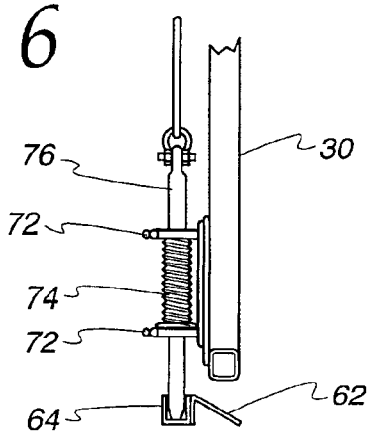
FIG. 6 is a side elevational view of a bottom locking pin attached to one of the end door of FIG. 3.
Figure 7:
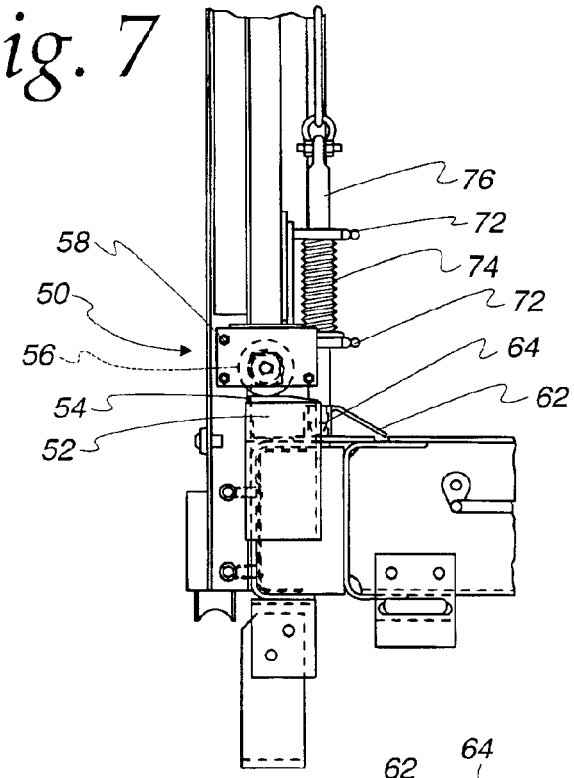
FIG. 7 is a side elevation view of a roller assembly attached to one of the end door of FIG. 3.

In the illustrated embodiment, the doors 30 are of a generally rigid configuration, i.e., they do not fold or bend significantly, and are preferably of a flat configuration, as distinguished from radial doors. As shown in FIG. 4, the end doors comprise a frame 38 having a plurality of attached panels 34. When the doors 30 are in their open positions, the brakes 134 and/or ladders 132 disposed on the ends of the railway car 1 may interfere with the doors 30. To reduce interference with the brakes 134 and/or ladders 132, the frame 38 proximate the bottom portion of the door 30 is recessed inwardly with respect to the upper portion of the door 30 to provide clearance between a recessed door panel 36 attached to the bottom portion of the door and the brakes 134 and/or ladders 132.

Figure 11:
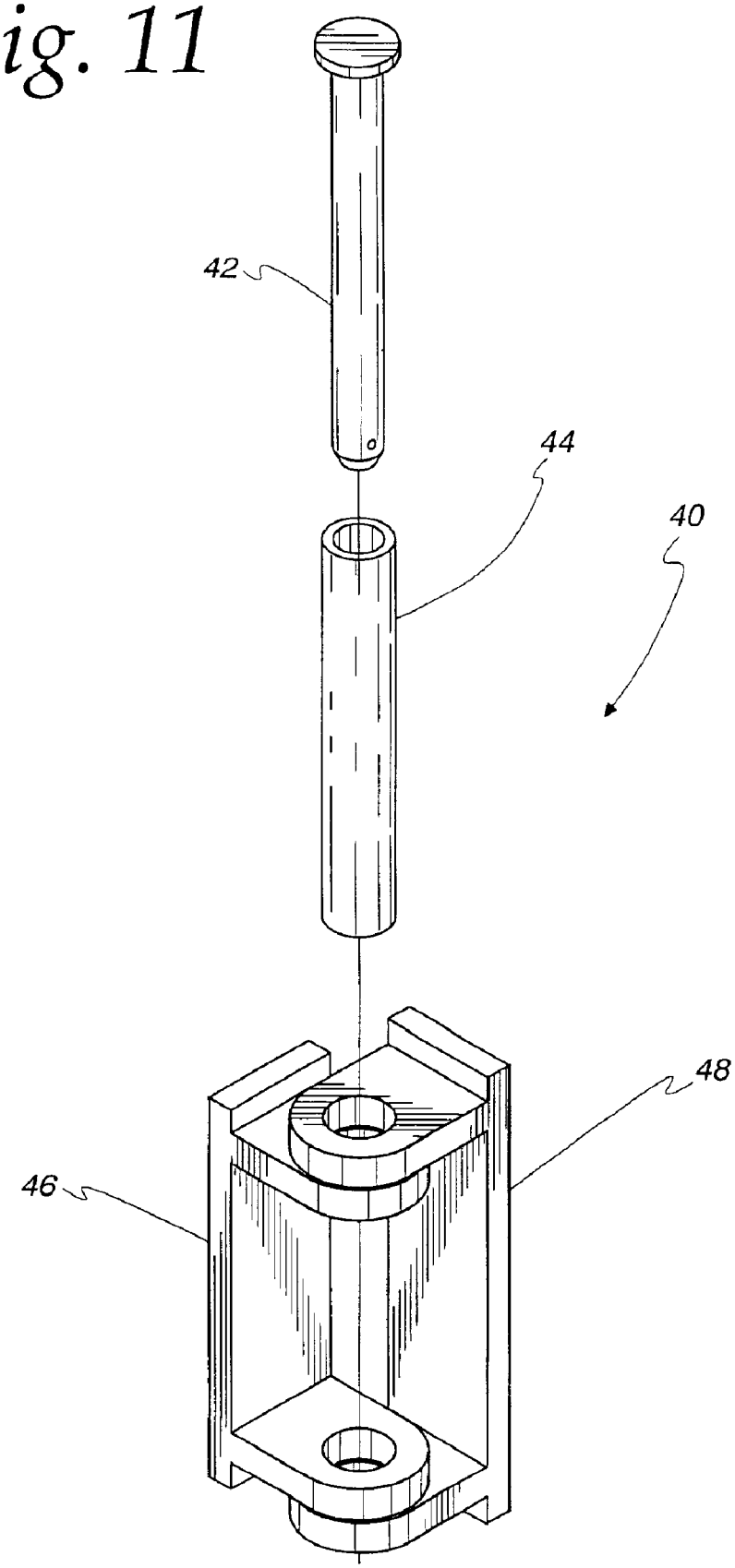
FIG. 11 is a perspective view of the hinge assembly according to an embodiment of the invention.

The end doors 30 are pivotally attached to the railway car 1 with hinges 40 comprising intermeshing male and female hinge members 46 and 48, as illustrated in FIG. 11, attached to the first side posts 22 and the end doors 30. A hinge pin 42 pivotably connects the male and female hinge members 46 and 48. The pin 42 comprises a pivot axis that the end doors 30 rotate about that is substantially coplanar with the sidewalls 18 of the railway car 1. A non-metallic bushing 44 may be disposed around the pin to reduce maintenance of the hinge 40, such as for periodic greasing or lubricating.

Locking mechanisms 70 are used to secure the end doors 30 in their closed positions and restrict access to the interior of the railway car 1. According to the embodiment of the railway car illustrated in FIGS. 5 and 6, the locking mechanisms 70 comprise locking pins 76 located at the upper and lower ends of the interior surfaces of each door 30. The pins 76 translate within locking pin brackets 72 mounted to the doors 30 between an extended or locked position and a retracted or unlocked position. A spring member 74 disposed around each pin 76 biases the pin 76 with respect to the brackets 72 to an extended position.

Attached to the floor 14 of the railway car 1 are pin tubes 64 for receiving the locking pins 76. The tubes 64 are disposed on the floor 14 at locations where the pins 76 extend downward when the doors 30 are in either their open and closed positions. When the extended pins 76 are received in the tubes 64, the doors 30 are prevented from moving between their open and closed positions. Pin tubes 64 are also disposed to receive the locking pins 76 located at the tops of the doors 30 when the doors 30 are in their closed positions. In the embodiment illustrated in FIGS. 5 and 8, the upper pin tubes 64 are attached to the bracket assembly 110 to provide additional locking security. Inclined pin ramps 62 are also provided leading upwards from the floor 12 towards the top of the pin tubes 64, or leading downward from the bracket frame 114 to the bottom of the pin tubes 64. As the pins 76 move up the pin ramps 62, the pins 76 are automatically retracted against the biasing force of the springs 74 to allow them to be received in the pin tubes 64. Once aligned with the pin tubes 64, the biasing force provided by the springs 74 returns the pins 76 to their extended positions, whereby the doors are either maintained in their open or closed positions by engagement of the pins 76 within the tubes 64.

A handle assembly 80 located on each door 30 is operable to move the locking pins 76 of the door 30 from their locked to their unlocked positions. The handle assembly 80 comprises a handle 84 rotatably mounted to the door. Rotation of the handle 84 from a locked position to an unlocked position translates the pins 76 to their retracted positions via cables 82 extending between the pins 76 and the handle 84. The cables 82 are slidable attached to the interior of the door 80 with cable guides 88 mounted to the door 30.

Due to the weight of the doors 30, door supports 50 are provided to maintain the doors 30 at a generally predetermined elevation relative to the floor 12 of the railway car 1 when the doors 30 are in either their open or closed positions. The supports 50 each comprise a roller bracket 58 mounted to the bottom of the door 30 opposite the hinges 40. Rotatably received within the bracket 58 is a roller 56 that at least partially protrudes beyond the bottom edge of the door 30. The roller 56 engages raised blocks 52 attached to and extending upwardly from the floor 12. The raised blocks 52 are positioned to be aligned with the roller 56 when the doors 30 are in either their open or closed positions. A wedge plate 54 is placed on top of each raised block 52 to ensure that the blocks 52 adequately support the rollers 56 and thus the doors 30.

To secure the semi-trucks 5 relative to the railway car 1, a plurality of parallel chocking tracks 120 extend longitudinally on the floor 12 of the railway car. The chocking tracks 120 are adapted for receiving chocking blocks for securing the wheels of the semi-trucks 5. Semi-trucks 5 often may have front wheels aligned with an inner set of back wheels. The trucks 5 may also include an outer set of back wheels that are not aligned with the front wheels. To accommodate chocking of both the front wheels and the outer back wheels of the trucks, an inner and outer set of chock tracks 124 and 122 are provided on each side of the railway car 1.

Figure 9:
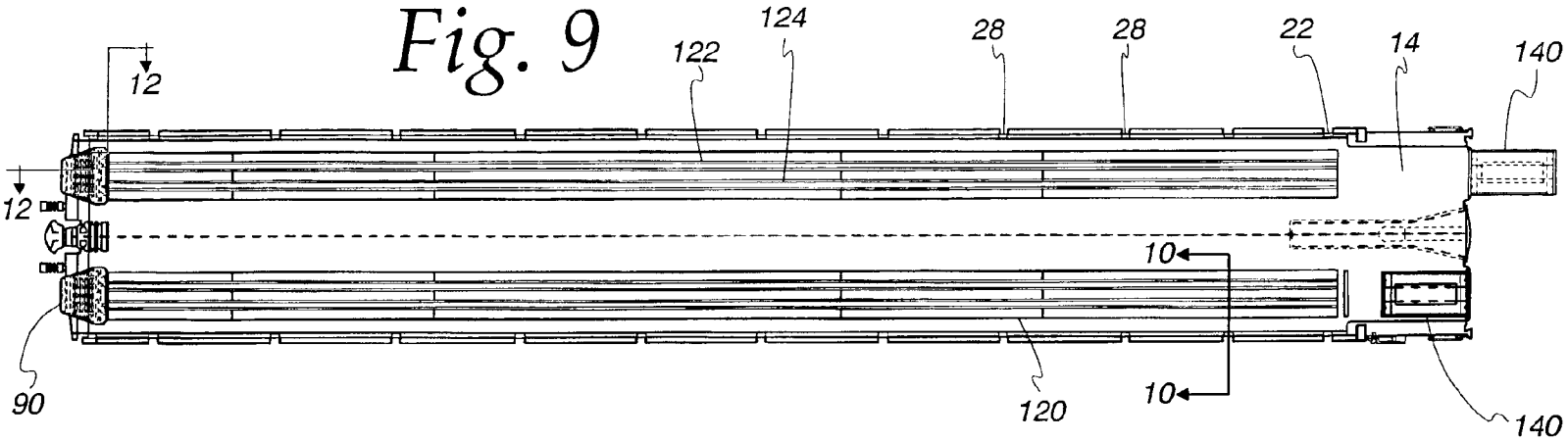
FIG. 9 is a plan view of a floor of the railway car of FIG. 2.
Figure 10:
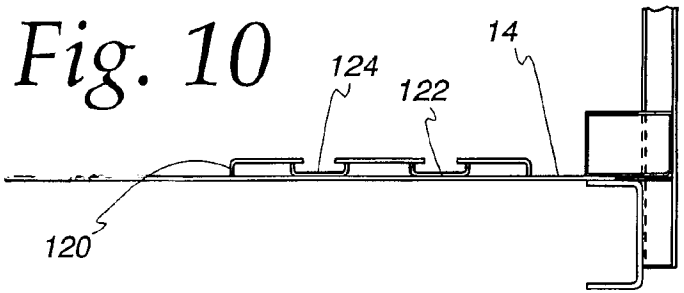
FIG. 10 is a section view of the floor of FIG. 9 taken along line 10—10.
Figure 12:
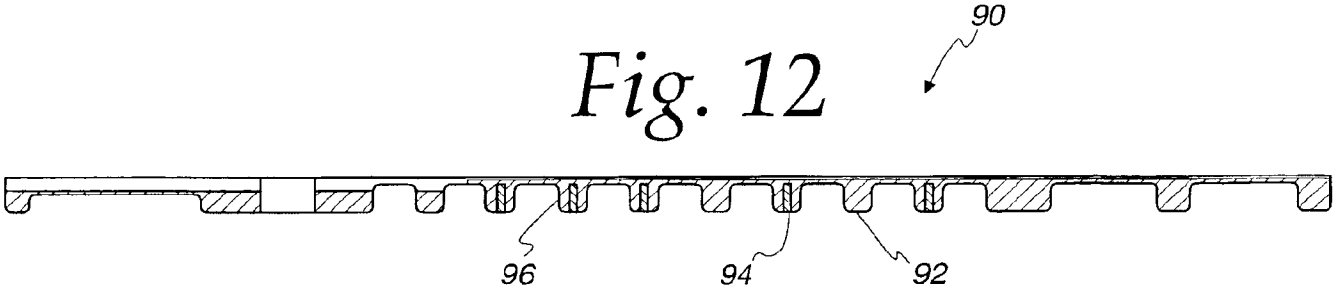
FIG. 12 is a sectional view of the bridge plate of FIG. 9 taken along line 12—12 in accordance with an embodiment of the invention.

A plurality of articulation bridge plates 90 are provided over the articulation 8 between the units 10 of the railway car 1. The articulation bridge plates 90 are mounted to allow each unit 10 of the railway car 1 to respectively pivot about the central truck 15, while still providing a support surface over which semi-trucks 5 can be rolled between units 10 of the railway car 1. The articulation bridge plates 90 are mounted to the floor 14 of the car units 10 in alignment with the chocking tracks 120, as illustrated in FIG. 9. The articulation bridge plates 90 are of sufficient strength to allow semi-trucks 5 to be driven thereover, allowing the trucks 5 to be loaded at one end of one of the units 10 and driven through the unit 10, over the articulation bridge plates 90, and into the other unit 10. In the embodiment illustrated in FIG. 12, the bridge plates 90 each comprise a polymer plate layer 92 reinforced with a plurality of ribs 96. Within the ribs are sheet metal strips 94 for additional reinforcement strength. In a preferred embodiment of the invention, the polymer comprises Metton. However, other suitable polymers may also be used for the articulation bridge plates 90.

Also disposed on the floor 14 at ends of the units 10 opposite the articulation 8 are end bridge plates 140 for extending between coupled railway cars 1. The end bridge plates 140 are pivotable between bridging and storage positions, as illustrated in FIG. 9. When in their bridging positions, each end bridge plate 140 extends between coupled railway cars to allow semi-trucks to be driven thereover. The bridge plates end 140 allow semi-trucks to be loaded onto a plurality of coupled railway car 1 by driving through a first railway car 1 and over the end bridge plates 140 to a next railway car. This loading operation may be repeated to allow a train comprising multiple coupled railway cars 1 to be loaded with semi-trucks 5 without having to uncouple each railway car 1 for separate unloading.

To load semi-trucks 5 on the railway car 1 for transportation, the end doors 30 of at least one of the railway car units 10 are both unlocked and moved to their open positions. The semi-trucks 5 may then be rolled or driven over the floor 12 of the railway car and over the bridge plate 90 to cross the articulation 80. Two semi-trucks 5 are placed end-to-end in each unit 10 of the railway car 1, according to the embodiment of the invention as illustrated in FIG. 2. After loading of the semi-trucks 5, the doors 30 are returned to their closed positions, whereby the door lock mechanisms 70 secure the end doors 30 in their closed position. To unload the railway car 1, the end doors 30 of at least one of the railway car units 10 are opened and the semi-trucks 5 are rolled or driven from the interior of the railway car 1.

From the foregoing it should be appreciated that the invention provides a novel and improved railway car for carrying semi-trucks. While preferred embodiments of the invention are described above, the invention is not limited to the preferred embodiments. For example, the invention may be embodied in a non-articulated car consisting of a single railway car unit. The invention is further described and more particularly pointed out in the following claims:

What is claimed is:

1. A railway car capable of cost-effective commercial shipment of semi-trucks comprising:

a support surface for carrying the semi-trucks;

a first pair of upstanding side posts spaced a distance from each end of the railway car;

a plurality of intermediate upstanding side posts disposed between the first pairs of side posts along each side of the railway car;

a pair of upstanding sidewalls connected to the first and intermediate side posts;

a roof extending between the sidewalls; and a pair of end doors pivotably supported proximate the first side posts and movable about pivot axes substantially coplanar with the sidewalls of the railway car between a closed position and an open position where edges of the doors in the open position do not extend beyond an end of the railway car.

2. A railway car in accordance with claim 1 wherein at least four semi-trucks can be transported end-to-end on the floor of the railway car.

3. A railway car in accordance with claim 1 wherein at least six semi-trucks can be transported on the floor of the railway car in a piggy-back arrangement.

4. A railway car in accordance with claim 1 wherein the first side posts on a side of the railway car are coplanar with the intermediate side posts on the same side of the railway car.

5. A railway car in accordance with claim 1, wherein the first side posts are positioned inward of the end of the railway car by a distance sufficient to enable the doors to open by pivoting about their outer edges without interfering with an adjacent car.

6. A railway car in accordance with claim 1, wherein the semi-trucks have a pair of inner rear wheels and pair of outer rear wheels and an inner and an outer chock track extend longitudinally on said support surface for securing the wheels relative to the support surface, the inner track positioned to be at least partially beneath one of the inner wheels of the semi-trucks and the outer chock track positioned to be at least partially beneath one of the outer wheels of the semi-trucks.

7. A railway car in accordance with claim 1, wherein a roller is attached to at least one of the end doors and extends at least partially beyond a bottom edge of the end door, the roller contacting a support member when the door is in either the open or closed position, the roller and support member effective to provide support for the door in either the open or closed position.

8. A railway car in accordance with claim 1, wherein the end doors are pivotably attached to the first end posts with hinges, the hinges each comprising a non-metallic bushing.

9. A railway car in accordance with claim 1, wherein the railway car comprises two units having an articulation therebetween.

10. A railway car in accordance with claim 9, wherein a reinforced bridge plate extends across an articulation between units of the railway car to allow the semi-trucks to be transported thereacross.

11. A railway car for transporting vehicles, said car comprising:

an interior defined by a single support surface for supporting the vehicles, a pair of upstanding sidewalls attached to side posts extending along each side of the railway car, and a roof extending between the sidewalls;

at least one cross support member extending between the sidewalls on opposite sides of the railway car, the cross support member constraining the sidewalls so that racking of the sidewalls remains within acceptable limits without an upper deck; and a pair of end doors for selectively enclosing an end of said railway car, the end doors being movable about pivot axes disposed proximate lateral edges thereof between a closed position in which the doors substantially enclose an end of the car, and an open position permitting access to the interior of the car, wherein the end doors in their open positions do not extend beyond an end of the railway car.

12. A railway car for transporting vehicles in accordance with claim 11 wherein each of the end doors in their open positions are substantially coplanar with the sidewalls on the respective sides of the railway car.

13. A railway car for transporting vehicles in accordance with claim 11 wherein semi-trucks can be transported end-to-end on the support surface of the railway car.

14. A railway car for transporting vehicles in accordance with claim 11 wherein semi-trucks can be transported on the floor of the railway car in a piggy-back arrangement.

15. A railway car for transporting vehicles in accordance with claim 11 wherein first side posts are positioned inward of an end of the railway car by a distance sufficient to enable the doors to open by pivoting about their outer edges without interfering with an adjacent car.

16. A method of transporting semi-trucks in an enclosed interior of a railway car having a single support surface for supporting the vehicles, the method comprising:

providing the railway car with end doors disposed proximate at least one end of the railway car, the end doors selectively operable between open and closed positions by pivoting about axes disposed proximate edges thereof;

moving the end doors to their open positions to provide access to the interior of the railway car, the end doors in their open positions not extending beyond the end of the railway car;

loading semi-trucks into the interior of the railway car; and closing the end doors to enclose the semi-trucks within the interior of the railway car.

17. A method of transporting semi-trucks according to claim 11, including the step of providing a support surface for the semi-trucks, a pair of upstanding sidewalls generally extending on longitudinal sides of the railway car, and a roof extending between the sidewalls to enclose the railway car.

18. A method of transporting semi-trucks according to claim 17, including reducing racking of the sidewalls of the railway car with at least one brace member extending between the sidewalls located on opposite sides of the railway car.

19. A method of transporting semi-trucks according to claim 17, wherein the semi-trucks comprise a pair of first pair of wheels spaced apart by a first dimension and a second pair of wheels spaced apart by a second dimension, wherein inner and outer chock tracks are provided on the support surface of the railway car, the method including:

aligning one of the first pair of wheels with the inner chock tracks and one of the second pair of wheels with the outer chock tracks;

chocking one of the first pair of wheels relative to the inner chock tracks; and chocking one of the second pair of wheels relative to the outer chock tracks.

20. A method of transporting semi-trucks having a pair of first pair of wheels spaced apart by a first dimension and a second pair of wheels spaced apart by a second dimension in an enclosed interior of a railway car, the railway car having a support surface for the semi-trucks with inner and outer chock tracks thereon, a pair of upstanding sidewalls generally extending on longitudinal sides of the railway car, and a roof extending between the sidewalls to enclose the railway car, end doors disposed proximate at least one end of the railway car, the end doors selectively operable between open and closed positions, the method comprising:

moving the end doors to their open positions to provide access to the interior of the railway car, the end doors in their open positions not extending beyond the end of the railway car;

loading semi-trucks into the interior of the railway car;

aligning one of the first pair of wheels with the inner chock tracks and one of the second pair of wheels with the outer chock tracks;

chocking one of the first pair of wheels relative to the inner chock tracks;

chocking one of the second pair of wheels relative to the outer chock tracks; and closing the end doors to enclose the semi-trucks within the interior of the railway car.

* * * * *